US005842295A

United States Patent [19]

Ching et al.

[11] Patent Number: 5,842,295

[45] Date of Patent: Dec. 1, 1998

[54] IRONING MACHINE HAVING AN IRON AND A STAND

[75] Inventors: Boon K. Ching; Tang P. Har; Albertus P. J. Michels, all of Singapore, Singapore

[73] Assignee: U. S. Philips Corporation, New York, N.Y.

[21] Appl. No.: 884,976

[22] Filed: Jun. 30, 1997

[51] Int. Cl.[6] ..... D06F 75/12

[52] U.S. Cl. ..... 38/77.6; 38/77.83; 219/246

[58] Field of Search ..... 38/77.3, 77.6, 38/77.5, 77.7, 77.83, 77.9, 79; 219/246, 247, 250, 256

[56] References Cited

U.S. PATENT DOCUMENTS

| | | | |
|---|---|---|---|
| 3,941,518 | 3/1976 | Eaton et al. | 417/442 |
| 4,535,556 | 8/1985 | Cavalli | 38/77.6 |
| 5,039,838 | 8/1991 | Ito et al. | 219/247 X |
| 5,315,773 | 5/1994 | Iwami et al. | 38/77.6 |
| 5,428,910 | 7/1995 | Gudefin et al. | 38/77.6 |
| 5,642,579 | 7/1997 | Netten et al. | 38/77.7 |

FOREIGN PATENT DOCUMENTS

| | | | |
|---|---|---|---|
| 0557901A1 | 9/1993 | European Pat. Off. . | |
| 2305600 | 12/1990 | Japan | 38/77.6 |
| 2307500 | 12/1990 | Japan | 38/77.6 |

*Primary Examiner*—Ismael Izaguirre
*Attorney, Agent, or Firm*—Robert J. Kraus

[57] ABSTRACT

An ironing machine is provided which includes an iron 1 and a stand 2. The iron 1 includes a steam generator 11 in the sole plate 15 of the iron 1. The stand 2 includes a reservoir 21, which is connected to the steam generator 11 by a duct 3. The ironing machine further includes a pump 22 in the duct 3, which pump 22 can be driven by an electric current, and flow-rate adjustment device 41. The flow-rate adjustment device 41 has at least three settings corresponding to different flow-rates of water into the steam generator 11 and includes a control unit 41 and a driver 45 to control the electric current supplied to the pump 22 in dependence on the setting. The control unit 41 has a manually adjustable selector 42 for selecting a setting and a trigger 43 for activating the pump 22. During use the user can depress the trigger 43 when steam operation is required. This causes the pump 22 to be activated, thus producing a flow rate of water into the steam generator 11 depending on the setting selected by the adjustable selector 42.

14 Claims, 2 Drawing Sheets

IRONING MACHINE HAVING AN IRON AND A STAND

BACKGROUND OF THE INVENTION

The invention relates to an ironing machine comprising an iron and a stand, the iron comprising a steam generator and the stand comprising a water reservoir, the water reservoir being connected to the steam generator by means of a duct, the ironing machine further comprising a pump driven by an electric current, for pumping water from the reservoir to the iron, and flow rate adjustment means having settings corresponding to at least two different flow rates of water to the steam generator.

Such an ironing machine is known from EP-A-0 557 901. The known ironing machine consists of an iron and a stand comprising a water reservoir and an electrical pump. The pump serves to pump water from the reservoir to a steam chamber of the iron via a duct. The flow rate of water into the steam chamber is adjustable by means of a valve. A disadvantage of the known ironing machine is that the pump is heavily loaded when a small flow rate is selected by the user. This requires a special pump or results in a reduced life of the pump. Another disadvantage of the known ironing machine is that due to component tolerances the range of flow-rate fluctuation at each setting is rather large. This could result in insufficient steam or in water spitting out when the flow rate exceeds the steaming capacity of the iron.

SUMMARY OF THE INVENTION

It is an object of the invention to provide an ironing machine with which the amount of water supplied to the steam generator can be adjusted in a convenient manner. To achieve this object the ironing machine according to the invention is characterized in that the flow rate adjustment means comprise an electrical control circuit for controlling the electric current supplied to the pump in dependence on the setting. Due to this measure the electric current supplied to the pump is adjustable, resulting in a desired flow rate of water to the steam generator. The pump is only loaded in so far as this is required in order to obtain a desired flow rate, as a result of which a longer lifetime of the pump is obtained. In addition, the pump can be chosen from a larger range, thus enabling the specifications and overall costs of the ironing machine to be optimized. A valve in the iron is not required so that there is more freedom in the mechanical design of the ironing machine.

An embodiment of the ironing machine according to the invention is characterized in that the flow rate adjustment means comprise a manually adjustable selector for selecting a setting. Due to these measures the user can choose the amount of steam generated by the steam generator.

An embodiment of the ironing machine according to the invention is characterized in that the selector is located at the iron. Due to this measure the user can operate the selector with the hand which holds the iron.

An embodiment of the ironing machine according to the invention is characterized in that the electric current pulsates or alternates with a frequency which depends on the setting. The variation of the frequency of the electric current in dependence on the setting results in a proper operation of the pump for low and high flow rates. The pump may, for example, be an electromagnetically driven piston pump or membrane pump.

An embodiment of the ironing machine according to the invention is characterized in that the iron comprises a spray nozzle, the spray nozzle being connected to the duct via a valve. By opening the valve, spray operation is obtained without the user having to operate a manual pump. As a result of these measures the spray function is very convenient to operate and a continuous spray operation is obtained.

An embodiment of the ironing machine according to the invention is characterized in that the valve is loaded by resilient means. This measure ensures that the valve is closed when the pressure in the duct is below a ceratin value. By setting the electric current to, for example, its maximum value, the pressure in the duct will increase and the valve will automatically open, resulting in water spraying out of the nozzle. Hence, the spray function can be activated with an electrical switch connected to the control circuit.

An embodiment of the ironing machine according to the invention is characterized in that the iron comprises a further valve located between the duct and the steam generator, the iron further comprising actuating means for closing said further valve and setting a predetermined electric current for the pump. By activating the actuating means the spray function will be started and the flow of water into the steam generator is interrupted so that the production of steam is not increased by activating the spray function.

An embodiment of the ironing machine according to the invention is characterized in that activation of the actuating means causes the further valve to be closed before said predetermined electric current is set. This measure prevents a short blast of steam from being generated when the spray function is activated.

An embodiment of the ironing machine according to the invention is characterized in that said actuating means cooperate with a chamber having a variable volume, the chamber being connected to the duct at a location between the pump and said further valve, release of the actuating means resulting in subsequent resetting of the electric current of the pump, the volume of the chamber being increased, and said further valve being opened. It has been found that at the end of a spray operation, the pressure built up in the duct results in a blast of steam when the valve to the steam generator is opened. Especially when the duct is made of a flexible material, which is necessary in order to obtain a flexible connection between the stand and the iron, this blast of steam may be substantial. By providing a chamber whose volume is increased after resetting of the electric current and before opening of the valve to the steam generator, the pressure in the duct is reduced, which precludes a blast of steam at the end of a spray operation.

An embodiment of the ironing machine according to the invention is characterized in that the volume of said chamber is variable by means of a movable piston, the actuating means comprising a manually depressible knob disposed at the outside of the iron and cooperating with said further valve, said piston and a switch being connected to the electrical control circuit, the valve being opened or closed, respectively, by depressing or releasing the knob over a first range of its stroke, the piston being moved by moving the knob over a second range of its stroke, and the switch being opened or closed, respectively, by depressing or releasing the knob over a third range of its stroke. These measures can easily be realized by conventional techniques using plastic injection-molded parts and result in the pressure in the duct being reduced before the valve to the steam generator is opened, thus preventing a blast of steam being produced at the end of a spray operation.

BRIEF DESCRIPTION OF THE DRAWING

Embodiments of the invention will now be described in more detail, by way of example, with reference to the drawings, in which.

DETAILED DESCRIPTION OF THE PREFERRED EMBODIMENTS

Figure 1:
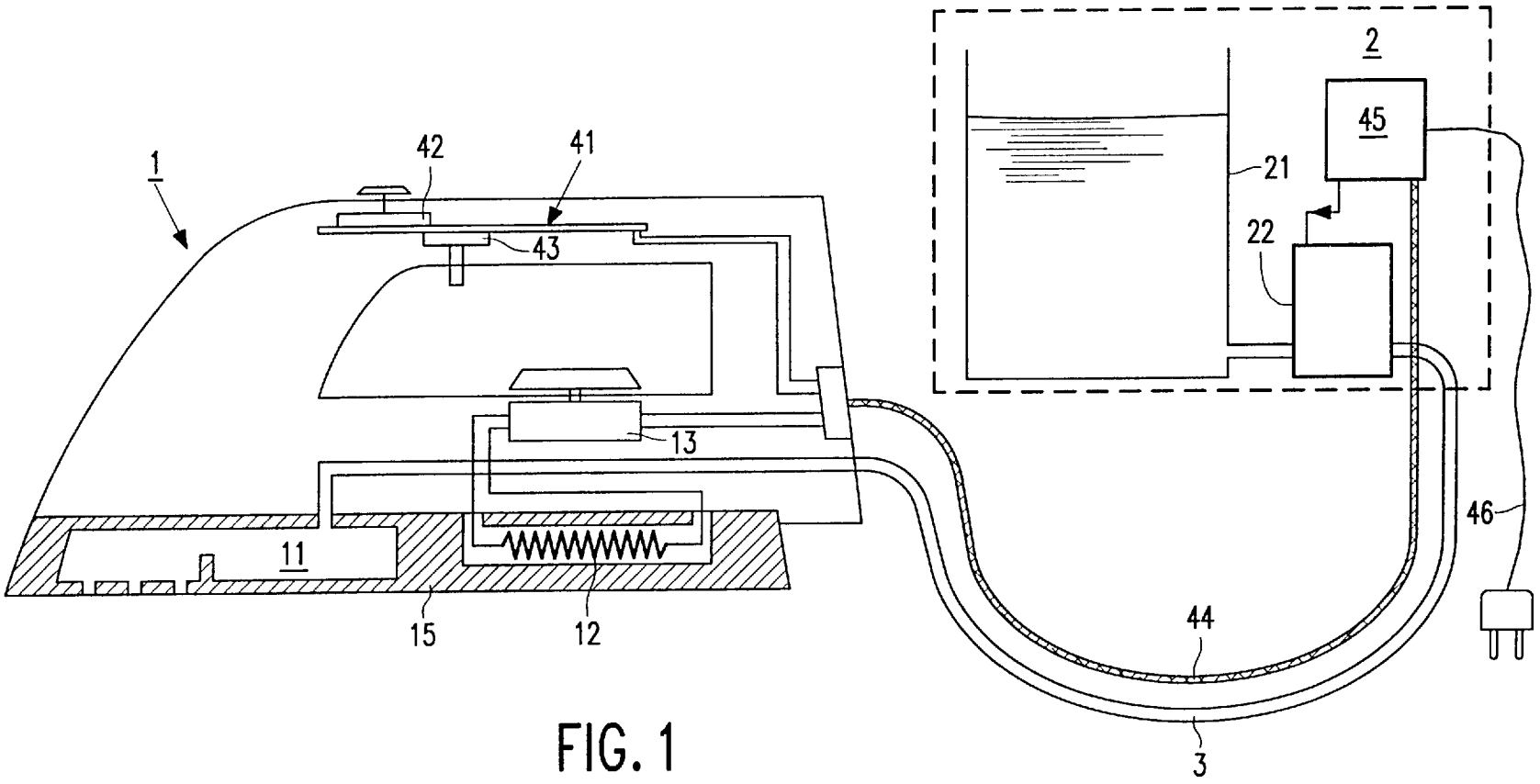
FIG. 1 is a diagrammatic representation showing a first embodiment of the ironing machine according to the invention.

FIG. 1 is a diagrammatic representation showing a first embodiment of the ironing machine according to the invention. The ironing machine comprises an iron 1 and a stand 2. The iron 1 comprises a steam generator 11, in this case in the form of a steam chamber in the sole plate 15 of the iron 1. The stand 2 comprises a reservoir 21, which is connected to the steam generator 11 by means of a duct 3. The ironing machine further comprises a pump 22 in the duct 3, which pump 22 can be driven by an electric current, and flow-rate adjustment means 41. The flow-rate adjustment means 41 have at least three settings corresponding to different flow-rates of water into the steam generator 11 and comprise an electrical control circuit, in this case in the form of a control unit 41 and a driver 45, to control the electric current supplied to the pump 22 in dependence on the setting. The control unit 41 comprises a manually adjustable selector 42 for selecting a setting and a trigger 43 for activating the pump 22. During use the user can depress the trigger 43 when steam operation is required. This will cause the pump 22 to be activated and to produce a flow-rate of water into the steam generator 11 in dependence upon the setting selected by means of the adjustable selector 42. Preferably, the control unit 41 is located in the grip of the iron 1 so that the trigger 43 and the selector 42 can be operated by the hand which holds the iron 1. The sole plate 15 is heated by means of a heating element 12, which is connected to the mains via a thermostat 13. The driver 45 comprises an electric power supply, which supplies the pump 22 with an electric current controlled by the control unit 41. The driver 45, which is located at the stand, is connected to the control unit 41 by means of the cable 44 and can be connected to the mains via a mains cable 46. The cable 44 also serves to connect the heating element to the mains cable 46. In this embodiment the electric current supplied to the pump 22 by the driver 45 pulsates or alternates with a frequency which depends on the setting of the manually adjustable selector 42. For example, the mains frequency is reduced to multiples of 2.5 Hz so that the frequency of the electric current supply to the pump 22 can be set to 2.5 Hz, 5 Hz and 7.5 Hz. Each of these frequencies corresponds to a different flow-rate of water from the water reservoir 21 to the steam generator 11. To obtain a self-cleaning operation the selector 42 may have a special setting, or a separate switch (not shown) may be provided to operate the pump at the mains frequency. In that case the pump 22 will deliver full flow into the steam generator 11. This large quantity of water will serve to flush out soluble salts and bits of insoluble scale.

Figure 2:
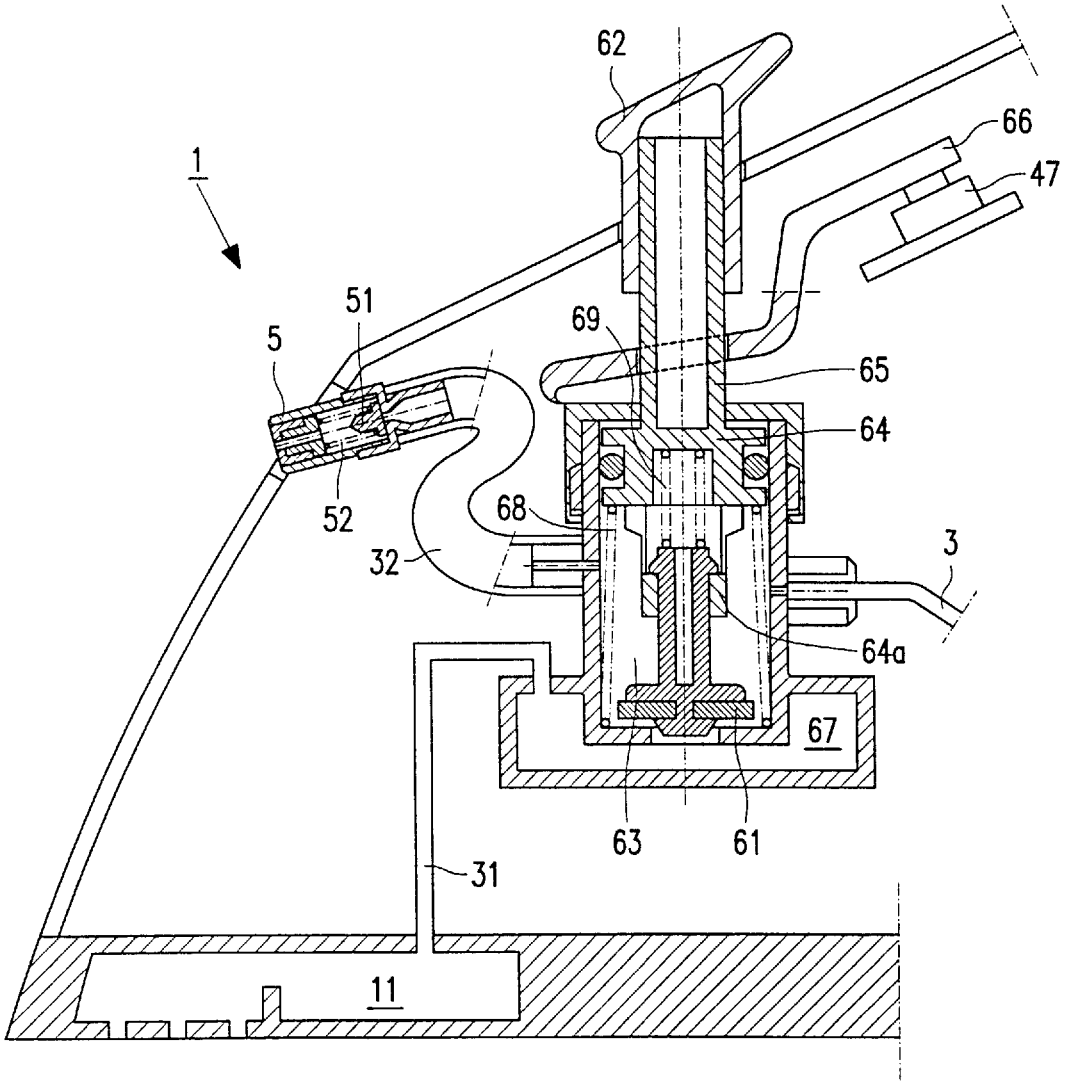
FIG. 2 shows a detail of an iron of a second embodiment of the ironing machine according to the invention.

FIG. 2 shows a detail of an iron of a second embodiment of the ironing machine according to the invention. In this second embodiment the iron 1 comprises a spray nozzle 5 at the outside, which spray nozzle 5 is connected to the duct 3 via a valve 51, another duct 32 and a chamber 63. The valve 51 is loaded by resilient means, in this case a spring 52. When the pump 22 is operated at a low frequency the pressure in the duct 3 will be such that the valve 51 remains closed. However, when the pump 22 is operated at the mains frequency the pressure in the duct 3 will rise, causing the valve 51 to be opened and a spray operation will result. In order to preclude increased steam production, the iron 1 comprises a further valve 61, which is located between the duct 3 and the steam generator 11, and actuating means, in this case in the form of a knob 62, for closing said further valve 61 and setting a predetermined electric current for the pump 22. The iron 1 comprises a chamber 63 which is connected to the duct 3 at the position between the pump 22 and the further valve 61. A piston 64, which bounds the chamber 63, is connected to the manually depressible knob 62 and is held in its upper position by a spring 68. The manually depressible knob 62 can activate a switch 47 via a lever 66. When the piston 64 is in it upper position an extension 64*a* of the piston 64 holds the further valve 61 in its open position against the force of another spring 69. In this open position of the further valve 61 water can flow from the duct 3 to a further chamber 67 through the chamber 63 and into the steam generator 11 through a further duct 31. The flow of water from the duct 3 into the steam generator 11 is dependent on the electric current supplied to the pump 22.

The spray operation will now be explained hereinafter. When the knob 62 is depressed by the user over a first range of its stroke, the piston 64 moves downwards and the further valve 61 is closed as a result of the force of the further spring 69, thereby causing the flow of water from the duct 3 to the steam generator 11 to be shut off. When the knob 62 is depressed over a second range of its stroke, the piston 64 moves further downwards, as a result of which the volume of chamber 63 is reduced, the purpose of which will be explained hereinafter. When the knob 62 is further depressed over a third range of its stroke, the knob 62 activates the switch 47 via the lever 66. The switch 47 is connected to the control unit 41 (see FIG. 1) in such a way that closing of the switch 47 causes the pump to be operated at the mains frequency, resulting in a spray operation. When the user releases the knob 62 the switch 47 is opened, which resets the electric drive current to the pump 22, and subsequently the piston 64 is moved upwards by the spring 68, causing the volume of the chamber 63 to be increased and the pressure in the chamber 63 and the duct 3 to be reduced. When the pressure in the chamber 63 is reduced the valve 51 is closed by the pressure of the spring 52 and the spray operation stops. Finally, the further valve 61 is lifted so that the duct 3 has an open connection to the steam generator 11. Since the volume of the chamber 63 is increased after the electric current to the pump has been reset, the pressure in the duct 3 is reduced and it is thus prevented that a large amount of water flows into the steam generator 11 when the further valve 61 is opened.

Hereinbefore the invention has been described for embodiments using modulation of the frequency of the electric current supplied to the pump 22. However, the flow of water may also be adjusted by modulating the level of the current supplied to the pump or the level of the voltage applied to the pump 22 in dependence upon the setting. It is to be noted also that the driver 45 and the control unit 41 can be integrated into one unit located either at the iron or the stand.

We claim:

1. An ironing machine comprising an iron and a stand, the iron comprising a steam generator and the stand comprising a water reservoir, the water reservoir being connected to the steam generator by means of a duct, the ironing machine further comprising a pump driven by an electric current, for pumping water from the reservoir to the iron, and flow rate adjustment means having settings corresponding to at least two different flow rates of water to the steam generator, wherein, the flow rate adjustment means comprise an electrical control circuit for controlling the electric current supplied to the pump in dependence on the setting.

2. An ironing machine according to claim 1, wherein the flow rate adjustment means comprise a manually adjustable selector for selecting a setting.

3. An ironing machine according to claim 2, wherein the selector is located at the iron.

4. An ironing machine according to claim 1, wherein the electric current pulsates or alternates with a frequency which depends on the setting.

5. An ironing machine according to claim 1, wherein the iron comprises a spray nozzle, the spray nozzle being connected to the duct via a valve.

6. An ironing machine according to claim 5, wherein the iron comprises a further valve located between the duct and the steam generator, the iron further comprising actuating means for closing said further valve and setting a predetermined electric current for the pump.

7. An ironing machine according to claim 6, wherein activation of the actuating means causes the further valve to be closed before said predetermined electric current is set.

8. An ironing machine according to claim 7, wherein said actuating means cooperate with a chamber having a variable volume, the chamber being connected to the duct at a location between the pump and said further valve, release of the actuating means resulting in subsequent resetting of the electric current of the pump, the volume of the chamber being increased, and said further valve being opened.

9. An ironing machine according to claim 7, wherein the volume of said chamber is variable by means of a movable piston, the actuating means comprising a manually depressible knob disposed at the outside of the iron and cooperating with said further valve, said piston and a switch being connected to the electrical control circuit, the valve being opened or closed, respectively, by depressing or releasing the knob over a first range of its stroke, the piston being moved by moving the knob over a second range of its stroke and the switch being opened or closed, respectively, by depressing or releasing the knob over a third range of its stroke.

10. An ironing machine according to claim 6, wherein said actuating means cooperate with a chamber having a variable volume, the chamber being connected to the duct at a location between the pump and said further valve release of the actuating means resulting in subsequent resetting of the electric current of the pump, the volume of the chamber being increased, and said further valve being opened.

11. An ironing machine according to claim 10, wherein the volume of said chamber is variable by means of a movable piston, the actuating means comprising a manually depressible knob disposed at the outside of the iron and cooperating with said further valve, said piston and a switch being connected to the electrical control circuit, the valve being opened or closed, respectively, by depressing or releasing the knob over a first range of its stroke, the piston being moved by moving the knob over a second range of its stroke and the switch being opened or closed, respectively, by depressing or releasing the knob over a third range of its stroke.

12. An ironing machine according to claim 6, wherein the volume of said chamber is variable by means of a movable piston, the actuating means comprising a manually depressible knob disposed at the outside of the iron and cooperating with said further valve, said piston and a switch being connected to the electrical control circuit the valve being opened or closed, respectively, by depressing or releasing the knob over a first range of its stroke, the piston being moved by moving the knob over a second range of its stroke and the switch being opened or closed, respectively, by depressing or releasing the knob over a third range of its stroke.

13. An ironing machine according to claim 1, wherein the valve is loaded by resilient means.

14. An ironing machine according to claim 13, wherein the iron comprises a further valve located between the duct and the steam generator, the iron further comprising actuating means for closing said further valve and setting a predetermined electric current for the pump.

* * * * *